US005199605A

United States Patent [19]

Schneider

[11] Patent Number: 5,199,605

[45] Date of Patent: Apr. 6, 1993

[54] CREAMY OR PASTY PRODUCT DISPENSER WITH A ROTATIONALLY CONTROLLED APERTURE IN THE CAP AND WITH SAFETY MEANS AGAINST UNCONTROLLED OPENING

[75] Inventor: Bernard Schneider, Sainte Menehould, France

[73] Assignee: Cebal, Clichy, France

[21] Appl. No.: 818,917

[22] Filed: Jan. 10, 1992

Related U.S. Application Data

[63] Continuation-in-part of Ser. No. 454,449, Dec. 21, 1989, abandoned.

[30] Foreign Application Priority Data

Jan. 6, 1989 [FR] France ..... 89 00292

[51] Int. Cl.[5] ..... B67D 5/06

[52] U.S. Cl. ..... 222/25; 222/39; 222/48; 222/521

[58] Field of Search ..... 222/25, 39, 46–48, 222/519, 520, 521

[56] References Cited

U.S. PATENT DOCUMENTS 4,690,304 9/1987 Morel ..... 222/521 X
4,878,604 11/1989 Barriac ..... 222/519 X
5,004,127 4/1991 Morel ..... 222/521
5,016,787 5/1991 Beck ..... 222/519 X
5,111,967 5/1992 Schreiber ..... 222/39

FOREIGN PATENT DOCUMENTS 0378488 7/1990 European Pat. Off. .

*Primary Examiner*—Andres Kashnikow
*Assistant Examiner*—Kenneth Bomberg
*Attorney, Agent, or Firm*—Dennison, Meserole, Pollack & Scheiner

[57] ABSTRACT

A dispenser having a head fixed on a body or a skirt, and a cap, with the cap comprising an outer skirt, a deformable internal crown and an intermediate ring, the head and the intermediate ring of the cap having complementary screw threads for raising and lowering the cap, the head including a stopper supported by sloping legs fixed inside the head and occluding an aperture of the cap when the cap is in a low position, the internal crown and the head cooperating sealingly once the cap is engaged on the head, the head including a shoulder which has at least one stop lug cooperating with a rib on the intermediate ring near its lower end to hinder an uncontrolled unscrewing of the cap when the cap is screwed downwards to close the dispenser.

13 Claims, 4 Drawing Sheets

FIG. 8
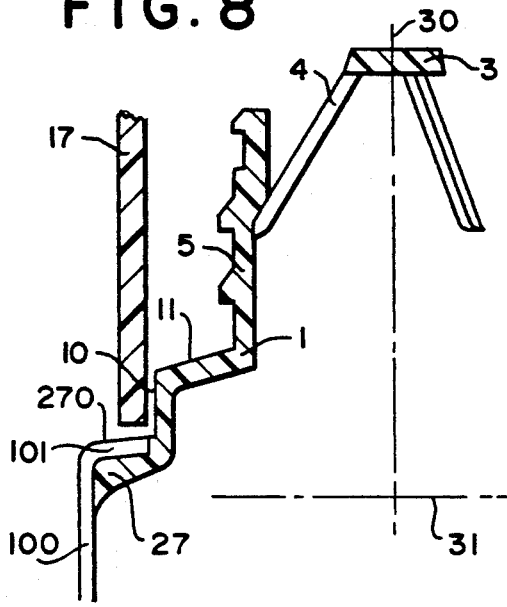
FIG. 9
(PRIOR ART)
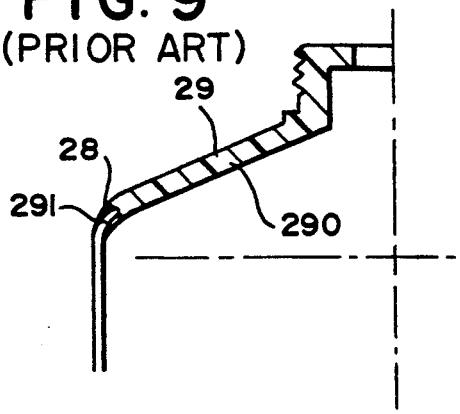
FIG. 11
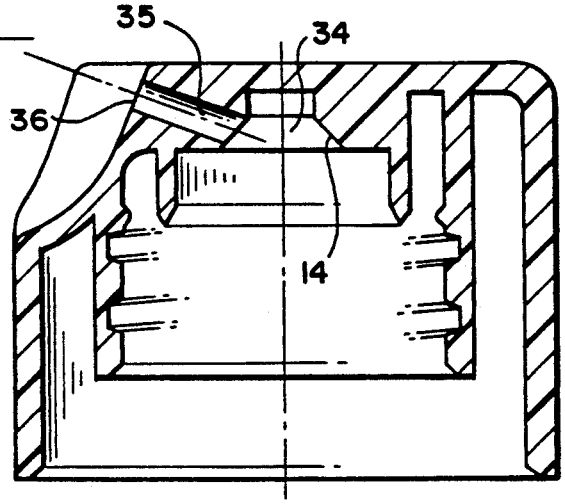
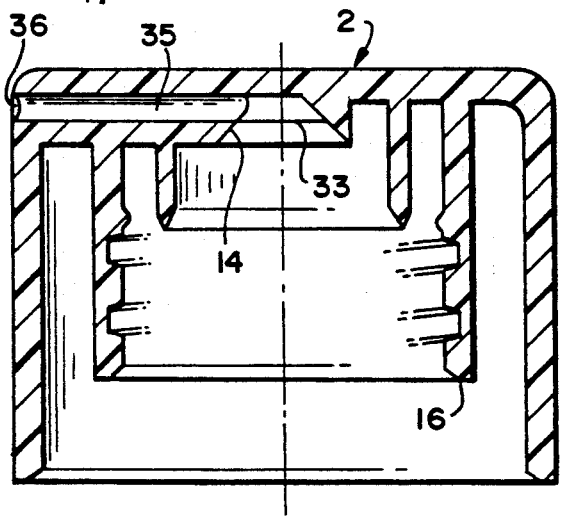
FIG. 10
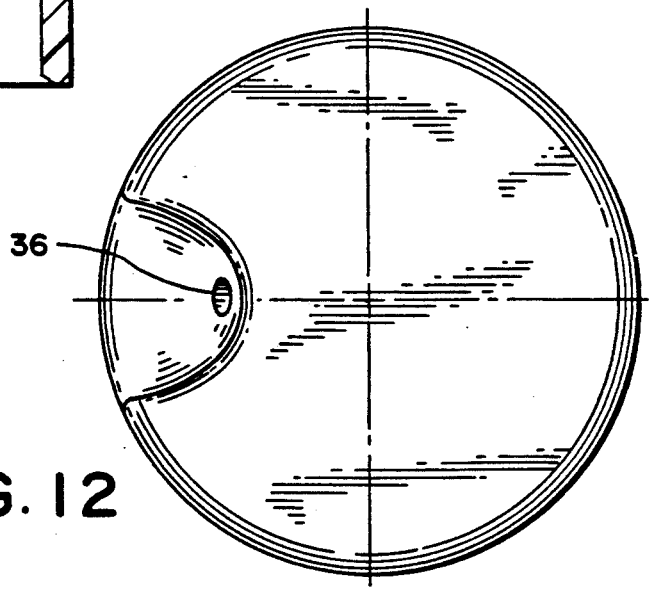
FIG. 12

CREAMY OR PASTY PRODUCT DISPENSER WITH A ROTATIONALLY CONTROLLED APERTURE IN THE CAP AND WITH SAFETY MEANS AGAINST UNCONTROLLED OPENING

This is a continuation-in-part of application Ser. No. 07/454,449, filed Dec. 21, 1989, now abandoned.

The invention relates to a means of distributing creamy or pasty product in which the central aperture in the cap is controlled by rotation of the cap.

Known from the Patent FR-B-2 574 377 (Morel U.S. Pat. No. 4,690,304) is a device for occluding a receptacle adapted to be opened and closed by the rotation of a cap. The raising and lowering of the pointed member which occludes the central orifice in the cap are controlled by the interaction of notches or pins on the valve-cap carrying the pointed member and sloping surfaces inside the cap. Sealing-tightness is provided by two concentric skirts in the valve cap, one bearing against a sealing-tight skirt in the cap and the other bearing against the inside of the ring on the container. The two-fold seal employed gives rise to friction and mediocre fluid-tightness, since the two sealing means can work in opposition to each other. Futhermore, the recessed sloping surfaces on the cap mean that its side wall is reduced in thickness, which may give rise to problems of decorative appearance. Furthermore, the sliding of the notches or pins in the sloping surfaces represents a certain clearance which, as the notches become worn, is accentuated which results in unsatisfactory guidance of the cap.

The Applicants have sought to perfect a dispenser which makes it possible to avoid these drawbacks. They tried also to avoid in this dispenser unscrewing of the cap, and if possible to indicate to the user its safe closing.

DISCLOSURE OF THE INVENTION

As is known from FR-B-2 574 377 (Morel U.S. Pat. No. 4,690,304), the object of the invention is a creamy or pasty product dispenser comprising a rigid head fixed on a body or skirt, and also a cap, the head and the cap comprising complementary means of raising the cap by rotating it, the cap comprising an aperture and the head comprising a stopper carried by sloping legs which have their bottom ends fixed to the inside of the head and which occlude this aperture when the cap is in the low position, the head and the cap carrying complementary sealing means. More precisely, in the invention, said complementary means, for raising and descending the cap consist of a screw thread on the outside of said head and of a complementary screw thread on the inside of an intermediate ring of the cap between an internal deformable crown and an outer skirt of said cap. Said complementary sealing means consists of said internal deformable crown and of a rigid upper portion of said head in which said crown is inserted sealingly once said cap is engaged on said head and is rotated. Said sloping legs supporting the stopper have their bottom ends fixed to the inside of said head below its said upper portion, providing between them large openings through which the product can pass. According to the invention, provided on said structure is safety means against uncontrolled unscrewing of said cap, especially during the handling or during a transport of said dispenser. Said head includes underneath its outside screw thread an annular shoulder, said shoulder bears at least one stop lug that extends above the level of the bottom end of said cap when said cap is screwed downwards so that its aperture is occluded sealingly by said stopper, said intermediate ring of the cap bearing near its lower end an exterior rib that has when the screwing is ending a forcible engagement with said stop lug and snaps beyond it, hindering an uncontrolled unscrewing of said cap, said stop lug and said rib constituting said safety means.

For better guidance of the cap and facility of engagement of its complementary raising means, it is preferable for the screw threads to consist of a plurality of (n) male threads which are circumferentially offset by 360°/n on the exterior of the head and of matching (n) female threads carried on the inside of said intermediate ring of the cap. In that way, there can be no visible trace of this female screw thread on the outside of the cap.

It has been found that in the present case a number (n) of threads equal to 3 was particularly advantageous, the stability of the cap during its rising or descending movement always being ensured without any question, because there is at all times an equilibrium between three small zones of contact between the male thread and the corresponding female thread, which are correctly spaced apart. If one departs from the 3 thread guide system, the choice should then by order of preference fall to 5 threads or 4 threads. The entry space to the three threads corresponds to their circumferential spacing of 360°/n, and to a pitch which gives a cap opening/closing distance which is normally less than one turn and which is preferably between $\frac{1}{8}$ and $\frac{1}{4}$ turn, a so-called "quick action" pitch being typically between 8 and 16 mm/turn. This entry space makes it possible easily to engage the threads of the head in the corresponding threads of the cap.

Said safety means against uncontrolled unscrewing of the cap, causing the contained product to leak outwardly through said aperture, have been found necessary in practice for the following reasons. Firstly, when the raising means consist of only one male thread and one complementary female thread, an uncontrolled unscrewing of the cap can be avoided only by a tight screwing which produces a gripping of the threads due to local damage. This is not a safe method and it may not succeed on each use of the dispenser. Secondly, when multiple threads are used and preferably when there are three threads, improving considerably the axial stability of the cap when raising or descending, screwing and unscrewing are obtained almost without effort, as the guidance of the threads is improved and their friction effects almost disappear, and as one cannot produce an efficient gripping of the threads at the end of the screwing, an uncontrolled unscrewing of the cap is then still more likely to occur in a handling operation or in a transport.

According to a first mode, said exterior rib and by said intermediate ring or "stop rib" has an essentially axial free edge which engages with an inner side edge of a stop lug and which snaps in the front of said lug. The "front side" is by convention the more advanced side in the screwing direction.

According to a second mode, which can be combined with the first mode, said exterior rib has the form of a blade and is a lower portion of an essentially radial element born in said intermediate ring, said rib or "sound rib" being separated from said ring, or from a root of said element attached to said ring, by an essentially axial slit which is open at its lower end. Said element has a circumferential position such than said separated sound rib engages by its lower end with the top edge of said stop lug, said sound rib according progressively on said top edge when said cap is furthermore downwards screwed, said rib finally escaping from said edge and vibrating and emitting a sound, and being arrested beyond the front side of said stop lug when the screwing is completed. Said sound is here a signal of a safe closing of the dispenser.

When one uses the last safety means alone, it is sufficient as when arrested the lower end of the sound rib is a few tenths of millimeter lower than the top edge of the stop lug. It can be even a little lower if the position of said element is such than this lower end engages with the stop lug when being for example 0.1 or 0.2 mm lower than the top edge of said lug. One adjusts typically the position of the element so that the screwing is completed and the dispenser closed when the back face of the sound rib is less than 1 mm after the stop lug.

The cap is preferably made of polypropylene, said sound rib is typically of a thickness of between 0.6 and 0.9 mm, said slit having a length of between 2 and 5 mm. Said length of the slit defines the frequency of sound signal, said rib has in practice a radial width sufficient to engage with at least half the radial length of the top edge of said stop lug.

When one uses both a "stop rib" and a "sound rib", it is preferred that they engage respectively and in an almost immediate succession with two stop lugs circumferentially offset by 120° on the annular shoulder of the dispenser.

Said sound rib engages at first, flexing on the top edge of the first stop lug and then escaping and emitting a sound as described hereabove, and when this sound is produced said stop rib has engaged with the second stop lug and has clicked or snapped in the front of said second lug, providing here the appropriate safety against an uncontrolled unscrewing, which could result in a leakage of product around the stopper of the dispenser. Several combinations of sound rib(s) and of stop rib(s) are possible, the number of stop lugs being eventually over three, the principles being for example to multiplicate the safety means, and/or to draw better the attention on the closing by using several sound ribs producing successively different sounds, thanks to their respectively different lengths of slits giving different lengths of the vibrating blades constituting said sound ribs.

Going back to the corresponding features of the head and of the cap, the bottom ends of the sloping legs are fixed to the inside of the head at a distance from the top end of this head which is greater than the operating distance of the cap or the difference in level between the fully open and the fully closed positions of the dispenser, the internal crown in the cap thus being always engaged in the interior surface of the neck-shaped head while the cap is being operated.

Once the cap is fitted on the head of the dispenser, the seal is established permanently and securely by the fact that said internal deformable crown of the cap fits with a clamping action against the inside cylindrical surface of the head, usually a clamping effect of 0.05 to 0.3 mm at the diameter and preferably 0.15 to 0.3 mm at the diameter. The opposition arrangements, that is to say the clamping fitment of such an internal crown of the cap around the top end of the neck or head would not be suitable for satisfactory sealing-thickness since the neck is more rigid than such an internal deformable crown and would prevent the use of the intermediate ring, described hereinafter, for arresting the axial rise of the cap.

The fixation of the sloping legs inside said neck of the head allows all the interior cylindrical surface of the upper portion of said neck to engage the internal sealing-tight skirt of the cap. With these long and thin sloping legs, usually three to five in number and with a transverse thickness which is typically comprised between 1 and for every direction of their cross-section 3 mm, a very aerated or open arrangement is obtained which favours passage of the product towards the outlet orifice and thus its return when the cap is closed, avoiding the product spilling out due to compression at the time of closure. This very open arrangement arises particularly from the high ratio between the maximum diameter of passage of the product between the sloping legs, that is to say at the level of their bottom ends, and the outlet diameter provided for product passing through the said aperture in the cap, a ratio which is normally 1.7:3.5 and preferably 2:3, and it makes it possible easily and without sudden spilling of product, to dispense creams and pastes having a viscosity ranging from 100 to 100,00 cP (100 to 100,000 mPa.s). One can notice that the total passage section of the cream or paste between the legs is typically 4 to 6 times the section of said aperture of the cap.

The intermediate ring in the cap which ensures the engagement and axial displacement of the cap by the cooperation of its generally recessed female screw thread with the male screw thread on the head is advantageously provided with an inner relief rib situated above the recessed threads, the end of the head being itself provided with an outer shoulder or rebate against which the rib can abut, so arresting the cap in its high or open position during normal operation of the dispenser.

The same outer rib and rebate may serve as a security means with regard to introduction of the cap or to prevent its involuntary removal, the rib having a rounded lateral surface and the rebate on the head having an sloping lateral surface opposite this rounded surface, these two surfaces achieving an engagement in which the cap is forcibly pushed onto the head, followed, thanks to the screwing action, by the click arrangement which locks the high position of the cap arresting rib under the outer rebate on the head.

The forcible action referred to corresponds to a clamping effect which is typically chosen between 0.05 and 0.25 mm at the radius, preferably between 0.08 and 0.15 mm at the radius. It has been found that if this forcing level is exceeded, engagement of the cap is difficult for a young child and that its disengagement, which requires a releasing of the click effect of the cap arresting rib, is then virtually impossible.

When the central aperture of the cap has a frustoconical lateral surface, the frustoconical lateral surface of the stopper has a total cone angle which is equal or may be slightly greater (by 0.5° to 10°) in order to achieve a good flush fit and a locking of the stopper in the aperture ensuring the finish of the downwards movement of the cap and the sealing-tight closure or its aperture or orifice.

Usually, the outer skirt of the cap is intended solely as a decoration. For purposes of appearance and general life of the receptacle, it preferably fits around a substantially cylindrical portion of the bottom of the head, for example with a clearance of 0.1 to 0.3 mm at the diameter. This engagement can be used to provide an indication that the dispenser has been opened, possibly in the form of a decoration, for example a colouring of the cylindrical portion which is revealed when the cap is unscrewed and rises, and which is masked by the downwards movement of the cap. This outer skirt improves maintenance of the cap and protects the socket-type clamping of the inner skirt of the cap on the inside of the head and the means of axial displacement of the cap.

The head, usually of plastics material, may be fixed on the body or on the skirt by an over-moulding, welding or gluing process, the body or the skirt being themselves of plastics or metalloplastics material (plastics material on the outside) in the first two cases. It is also possible to produce the head fixed on the body or on the skirt in one single moulding operation.

This moulding operation consists preferably of a molten plastics injection from the top of the head, which is here the stopper, the injection stream descending then to form the structure of the head, finishing by its shoulder, its cylindrical portion and by an annular sealing portion having the form of a small second shoulder in which the top edge of the body or the skirt of the dispenser is bound to the head. So that the masking of the cylindrical portion by the outer skirt of the cap is better, this annular sealing portion is preferably only slightly inclined on a horizontal direction, i.e. on any direction perpendicular to the axis, by 0° to 20°, preferably no more than 15° or still better 0° to 10°. The fixation shoulders of the tubes are usually inclined at 30° or more, and the applicant has discovered here that, having an injection of plastics axial with at its base an almost perpendicular annular cavity in which the bent end of the body or skirt is maintained, the molten plastics, instead of inserting both above and under this bend end in the cavity, surprisingly spreads only under said bent end and pushes it upwards against the moulding tool. When the injected plastics material is of a different colour, this effect produces an annular sealing portion which is all or almost all of the material constituting the outer surface of the body or skirt, making clearer the distinction between the closed position of the cap and the beginning of its raising.

As will be shown in the Examples, the whole structure of the dispenser can be used with a lateral aperture of the cap, emerging eventually in a depression of said cap, a lateral portion of the stopper producing then the closure of the aperture.

The dispenser according to the invention has many advantages: simple structure with excellent sealing-tightness, both towards the cap and towards the closing of its aperture; excellent guidance in the preferred case of a three threads screw thread, making the sealing still better and maintaining a good working throughout the use of the dispenser; having excellent safety means to avoid uncontrolled unscrewing, particularly when handling or transporting the dispenser. The invention applies to any dispenser having a pressable or squeezable body or skirt, e.g. a flexible skirt pressed by hand or a bag comprised in a pressure chamber.

The dispenser according to the invention is used in the pharmaceuticals, cosmetics, hygiene and foodstuffs fields.

The invention will be more clearly understood from the following example which is shown in the accompanying drawings, in which:

FIG. 8 shows the overmoulded structure of the head having at its bottom a less inclined annular sealing portion, as a half axial cross-section;

FIG. 9 shows a comparison prior art tube head;

FIG. 10 shows a cap having a lateral aperture, in axial cross-section;

FIG. 11 and FIG. 12 show another cap having a lateral aperture emerging in an external depression of said cap, in cross-section and from above.

EXAMPLE 1

Basic structure of the dispenser

Figure 1:
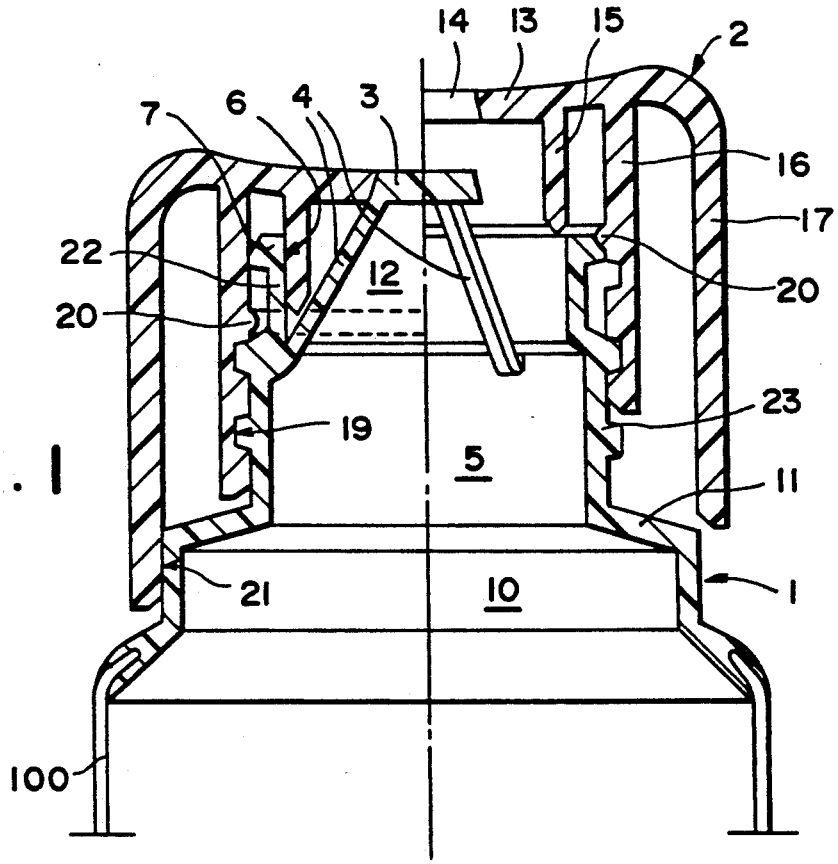
FIG. 1 shows in half axial section, on the right the position of the cap when it is first fitted on the dispensing head, on the left the position of closure when it is closed.

The device according to the invention (FIG. 1 and 2) comprises a dispenser head 1 and a cap 2. The head 1 is of high density polyethylene 1 mm thick overmoulded onto a medium density PE skirt which is 0.5 mm thick. The cap is of moulded PP (polypropylene) with a thickness of 1.25 mm at the location of its outer skirt. The head 1 comprises a frustoconical stopper or plug 3 carried by three obliquely disposed legs 4 connected to the interior of the neck 5 between an upper portion 22 and a lower portion 23 of said neck, and having a "transverse" width, that is to say in a direction at right-angles to the axial plane passing through the leg 4 in question, and an axial width, which are both equal to 1.5 mm. This neck 5 has an inner cylindrical end surface 6 of diameter 14 mm. It carries at its top end an outer rebate 7 comprising at the top a chamfer 8. The outer surface of the neck 5 carries three threads 9 of semi-rectangular cross-section disposed at 120° from one another. The bottom part of the head 1 consists of a cylindrical portion 10 of diameter 27.5 mm connected to the upper part by a flared frustoconical portion 11. The plug 3, the legs 4 and the neck 5 define wide passages 12 through which the pasty or creamy product contained in the receptacle can escape when the receptacle is being used.

The open disposition of the legs 4 allows the product to fall back freely when the orifice 14 is closed by the stopper 3, so avoiding undesired emergence of product due to over:pressure caused by internal constriction.

The cap 2 comprises at the top a web 13 in which there is a frustoconical aperture 14 similar to the side of the stopper 3. The cap comprises three concentric skirts : an internal deformable crown 15, having an outer cylindrical surface 18 of diameter 14.2 mm which bears with force against the inner surface 6 above the bottom of the legs 4; then an intermediate ring 16 of internal and external diameters respectively 18 mm and 21 mm, said ring comprising on its inside surface a female screw thread 19 corresponding to the threads 9 and which is surmonted by a circular arresting rib 20 of substantially semi-circular cross-section. The outer skirt 17 comprises an inner bottom surface 21 which fits with clearance around the outer surface of the cylindrical portion 10.

The outlet diameter of the orifice 14 is in this case 5 mm and the diameter for passage of product at the level of the bottom of the supports 4 is 14 mm, the corresponding ratio of passage diameter: product outlet diameter therefore being 2.8.

The legs 4 are 5 mm high and 8 mm long, the total openings between them being of about 110 $mm^2$.

In the position of engagement (on the right in FIG. 1), the stopper is engaged by translation and then rotation (as it is screwed) into the upper part of the threads 9. Continuing the movement of rotation allows the rib 20 to negotiate the shoulder 7 with force, thanks to the chamfer 8. Screwing may be continued until the aperture 14 (on the left in FIG. 1) is completely closed by the stopper 3.

Figure 2:
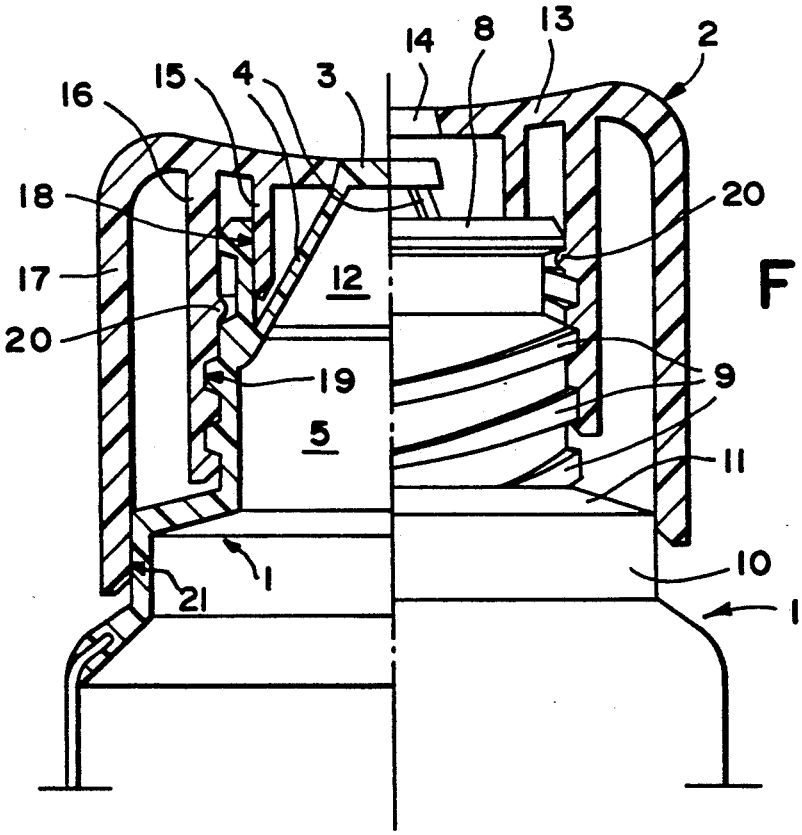
FIG. 2 shows in half axial section, on the left, the same closed position of the cap, and, in half section through the cap and with an external view of the head of the dispenser on the right, the cap in the open position.

When unscrewing, the aperture 14 is clear and the stopper is retained in the high position by the rib 20 which bears on the shoulder 7 (on the right in FIG. 2). By forcing the rotation in the "unscrewing" direction at this location, it is possible to free the cap 2 from the body of the dispenser 1 but this goes beyond normal use of the dispenser.

This operation is not carried out during normal use of the dispenser, the cap only being moved between the closed position (on the left in FIG. 2) and the open position (on the right in FIG. 2).

Numerous tests with successive dispensing and closing actions were carried out with dispensers according to the above embodiment, containing a moisturising cream with a viscosity of 6000 cP. There was no spilling of cream on the outside of the outlet orifice 14, in contrast to what was observed with the prior art dispensers.

EXAMPLE 2

Modified dispenser, having safety means against uncontrolled unscrewing of the cap and an improved sealing portion (FIG. 3 to 8)

Figure 3:
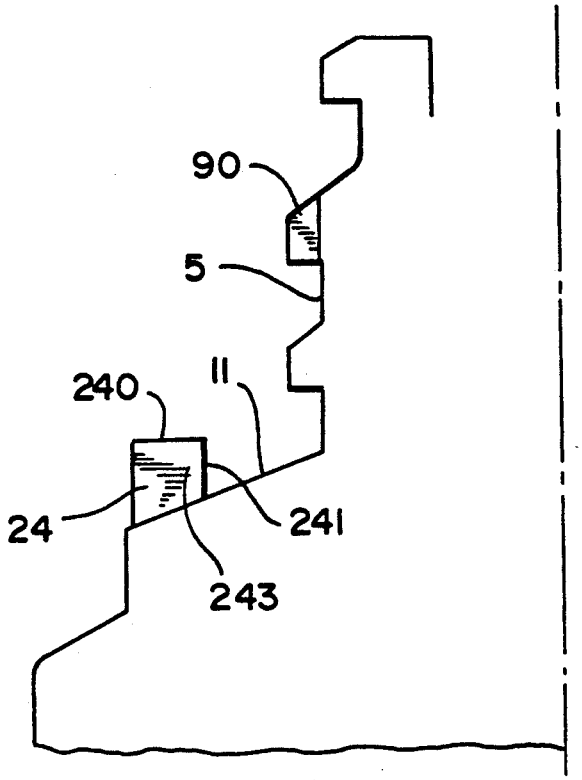
FIG. 3 shows a profile of the head of the dispenser, bearing on its shoulder a stop lug, in half view.
Figure 4:
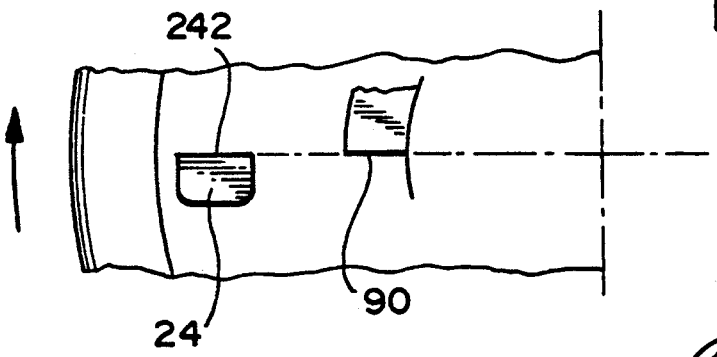
FIG. 4 shows the same from above.

In this dispenser, all the features already described remain the same. As the unscrewing of the cap is axially very stable, but is so easy that the cap does not remain securely closed, the shoulder 11 is equipped with three stop lugs, of which two 24 and 245 are shown, essentially radial 1.5 mm thick and 2 mm long, standing between the diameters 23 mm and 27 mm and having an horizontal top surface 240 and an axial inner edge 241 (FIG. 3). The front side 242 of each stop lug 24, 245 is in a same axial plane as the departure 90 or top end of a male thread on the neck 5 (FIG. 4).

Figure 5:
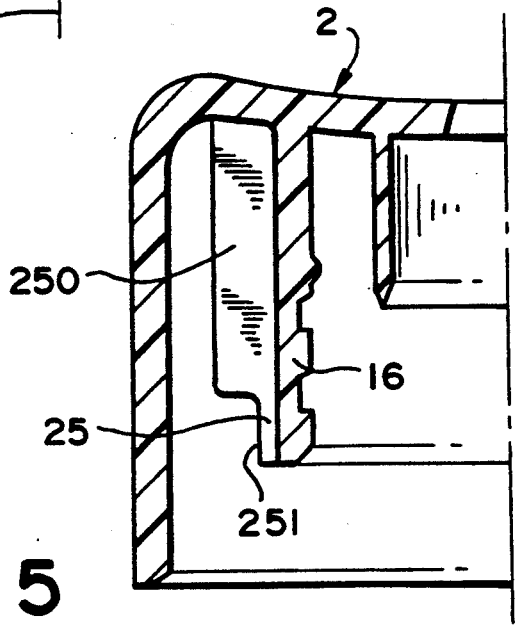
FIG. 5 shows a portion of the cap, bearing a stop rib, in half cross-section.
Figure 6:
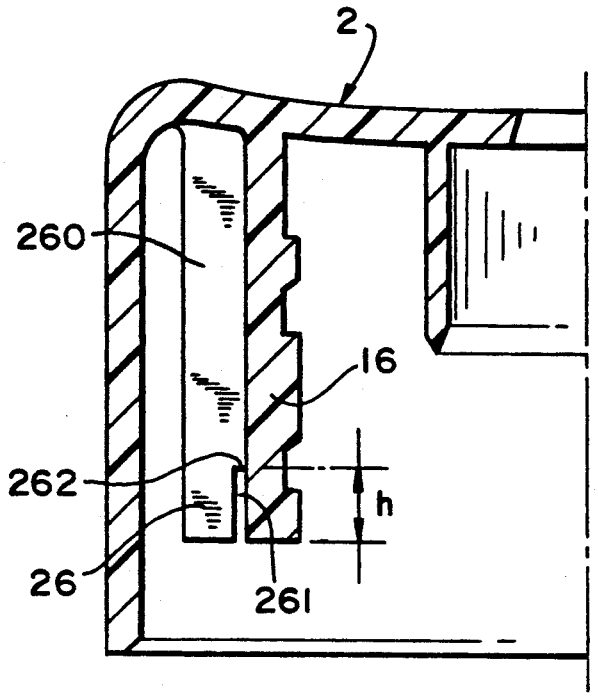
FIG. 6 shows another portion of the cap, bearing a sound rib, in half cross-section.
Figure 7:
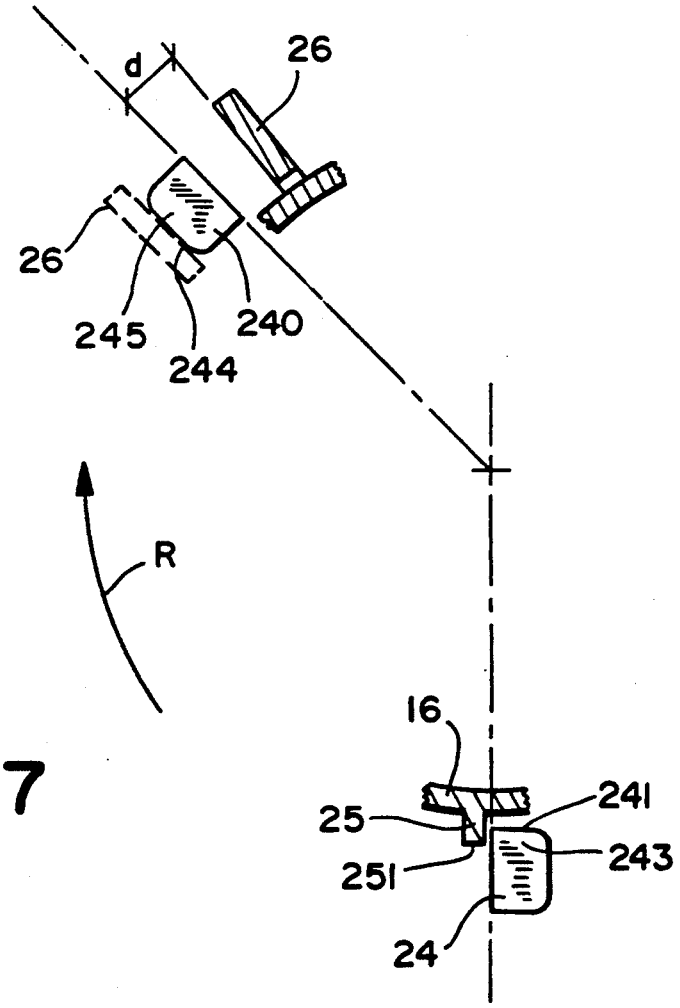
FIG. 7 shows from above two stop lugs having cooperated respectively with a sound rib and with a stop rib, at the end of the screwing of the cap.

The intermediate ring 16 of the cap 2 bears two different safety ribs 25 and 26 (FIG. 5 to 7). The first one 25 called here "stop rib" is the lower portion 25 of a radial flat wing or blade 250 on the exterior of the intermediate ring 16 (FIG. 5). For its strength and for the ease of injection moulding, this wing extends from the top of the cap and narrows downwardly to its lower portion forming the stop rib 25. The rib 25 has a width such that its axial free edge 251 overlaps the interior portion 243 and the axial inner edge 241 of the stop lug 24 by 0.5 mm. The stop rib is 0.8 mm thick, its click engagement to pass a stop lug 24 when the screwing and the closing of the cap 2 is being completed will be easy with rotation and with a small effort, but uncontrolled unscrewing from the enclicked position will not be possible. Generally speaking, the engaged width of such a stop rib 25 will be satisfactory when comprised between 0.3 and 0.8 mm, and its thickness is preferably between 0.6 and 1 mm.

The intermediate ring 16 also carries a sound rib 26 that cooperates with a second stop lug 245 offset circumferentially versus the first one by 120° in the direction of the screwing. The sound rib 26 is circumferentially offset by 128° versus the stop rib 25, and consists of a lower portion 26 of a bladelike element 260 carried by the intermediate ring 16 up to the top of the cap 2. The lower portion or sound rib 26 is separated from the element 260 and/or the ring 16 by an axial slit 261 which is open at its lower end and has a length or height "h" of 3 mm and a width of 0.4 mm at its bottom 262. The sound rib 26 is 0.8 mm thick, 2.5 mm wide, situated between the diameters 22 mm and 27 mm, 3 mm high and vibrates producing a signal sound when it has deflected on the second stop lug 245 and has become free or in released in front of it. In the situation represented in FIG. 7, successive events have been, when finishing the screwing :

- the sound rib 26 (phantom lines) contacts, the back face 244 of the second stop lug 245, with a small overlap, about 0.2 mm;
- rotation (arrow R) continues, the bottom end of the sound rib 26 is moved to and frictionally engages on the top end or surface 240 of the stop lug 245, with progressively more and more bending during a circumferential movement of about 3 mm preceding its escaping from said stop lug 245 : the pitch of the threads 9 is of 10 mm/turn, and the lowering of the lower end of the sound rib 26 has increased the overlap by 0.25 mm during its movement, it is 0.45 mm lower than the top surface 240 when it escapes;
- so that the sound is well produced, the final position of the sound rib is here at a distance "d" from 1.5 to 2 mm of the stop lug 245;
- when the sound is produced, the stop rib 25 has passed laterally the first stop lug 24 (FIG. 7), and the cap is well closed by that stop rib 24 which is blocked in the front of the stop lug 25 by 0.5 mm of its width.

Here, the sound rib 26 is not used as an arresting means. It could be used as arresting means, but it would be difficult to have both a good sound signal and a closing acceptable for all transport conditions. Different sounds could be obtained by adjusting the length of the slit 261 between 2 and 5 mm.

Improved sealing portion (FIG. 8 and FIG. 9 for prior art)

The annular sealing portion 27 under the cylindrical portion 10 of the tube is the injection moulding portion binding sealingly the head 1 of PE.HD and the skirt 100 which is in the present case multilayer, 0.3 mm thick having a barrier polymeric layer, each face of which is covered by PE surface layers. The injection of the head 1 over the skirt 100 is performed downwards from the stopper 3 and its three legs 4 to the neck 5, the shoulder 11, the cylindrical portion 10, and the composite annular sealing portion 27. The bent portion 101 of the skirt 100 after injection moulding forms the surface 270 of the annular sealing portion 27, this surface 270 being inclined at 15° on the horizontal plane 31 defined as perpendicular to the axis 30 of the head 1.

FIG. 9 shows the structure of the composite binding zone of a prior art tube having a head overmoulded on a skirt. This binding zone 28 at the outer end of the shoulder 29 shows in axial cross-section that the injected plastics material 290 has come over and under the end 291 of the skirt. The shoulder 29 is inclined at 30° to 40° on the horizontal plane 31.

Coming back to FIG. 8, showing only the colour of the skirt 100 when the cap 2 is closed and around the cylindrical portion 10 makes this closed situation clear when the plastics material of the injected head 1 is of a different colour. As an example, both the skirt and the head may be of PE.

Lateral aperture of the cap (FIG. 10 to 12)

When the cap 2 is lowered for closing a surface 14 under the aperture 33 or 34, or the lateral aperture itself such can be sealed by the lateral surface of the stopper 3. The surface 14 and the lateral surface of the frustoconical as on FIGS. 1–2 and 8, and give progressive sealing. The aperture may be extended by a canal 35 having an outlet orifice 36. When this orifice 36 is in a depression (FIG. 11 and 12), there is less cream remaining in the canal 35 after distribution.

I claim:

1. A creamy or pasty product dispenser including a rigid head fixed on a body and having an inside and an outside, and a cap engageable with said head, said cap comprising an outer skirt, a deformable internal crown and an intermediate ring which is between said outer skirt and said internal crown, said intermediate ring having an inside, said head and said cap including complementary screw threads for raising and lowering the cap comprising a screw thread on the outside of said head and a complementary screw thread on the inside of said intermediate ring, said cap including an aperture and said head including a stopper supported by several sloping legs fixed at their bottom ends to the inside of said head below an upper portion of said head, said stopper occluding said aperture when the cap is in a lowered position on said head, said deformable internal crown and said upper portion of said head cooperating sealingly once said cap is engaged on said head, said head including an annular shoulder below its screw thread, said shoulder having at least one stop lug thereon with a radial length and with a top end above the bottom of said cap when said cap is screwed downwards to a lowered position wherein said stopper occludes sealingly said aperture, said intermediate ring having an exterior rib that in the lowered position of the cap has a forcible engagement with said stop lug and snaps beyond it, hindering an uncontrolled unscrewing of said cap, said rib having the form of a blade 0.6 to 0.9 mm thick and being a lower portion of an essentially radial outer element on said intermediate ring, said rib having a lower end and being of a radial width sufficient to engage with said top end along at least half the radial length of said stop lug, said rib being defined by an essentially axial slit between said rib and said ring, said slit being open at its lower end and having a length of between 2 and 5 mm, said element being positioned whereby as said cap is screwed downward on said head, said rib lower end engages with said top end of said stop lug, said rib flexing and progressively bending on said top end, said rib then releasing beyond said top end and vibrating and emitting a sound and being arrested beyond said stop lug when the screwing is completed, said length of the slit defining the frequency of said sound signal, said sound being a signal of a safe closing of the dispenser.

2. A creamy or pasty product dispenser including a rigid head fixed on a body and having an inside and an outside, and a cap engageable with said head, said cap comprising an outer skirt, a deformable internal crown and an intermediate ring which is between said outer skirt and said internal crown, said intermediate ring having an inside, said head and said cap including complementary screw threads for raising and lowering the cap comprising a screw thread on the outside of said head and a complementary screw thread on the inside of said intermediate ring, said cap including an aperture and said head including a stopper supported by several sloping legs fixed at their bottom ends to the inside of said head below an upper portion of said head, said stopper occluding said aperture when the cap is in a lowered position on said head, said deformable internal crown and said upper portion of said head cooperating sealingly once said cap is engaged on said head, said head including an annular shoulder below its screw thread, said shoulder having two stop lugs thereon circumferentially offset by 120° and extending above the bottom of said cap when said cap is screwed downwards to a lowered position wherein said stopper occludes sealingly said aperture, said intermediate ring having a first exterior rib that in the lowered position of the cap has a forcible engagement with a first of said stop lugs and snaps beyond it, hindering an uncontrolled unscrewing of said cap, said first rib having the form of a blade, and being a lower portion of an essentially radial outer element on said intermediate ring, said first stop lug having a radial length and a top end, said first rib having a lower end and a radial width sufficient to engage with said top end of said first lug, said first rib being defined by an essentially axial slit between said rib and said ring, said slit being open at its lower end, said element being positioned whereby as said cap is screwed downward on said head, said first rib lower end engages with said top end of said first stop lug, said first rib flexing and progressively bending on said top end, said first rib then releasing beyond said top end and vibrating and emitting a sound and being arrested beyond said first top lug when the screwing is completed, said sound being a signal of a safe closing of the dispenser, the second of said stop lugs having an inner axial free edge, a second rib on said intermediate ring having an essentially axially free edge which engages with said inner axial edge and snaps beyond said second lug when the screwing of said cap to the lowered position is completed, said second rib more closely preventing an uncontrolled unscrewing of said cap.

3. A dispenser according to claim 1 or claim 2, in which said complementary screw threads each consist of three threads offset circumferentially by 120°, the axial stability of said cap being consequently improved during its raising or lowering.

4. A dispenser according to claim 3, in which said deformable internal crown comprises a thinner flexible portion of a thickness between 0.2 and 0.4 mm over 2 mm from its end, said end entering said upper portion of said head with a clearance, and a deformable base portion entering said upper portion with a forcing effect of 0.15 to 0.3 mm on the diameter, the sealing of said internal crown into said upper portion being maintained in any position of said cap due to the axial stability provided by said threads.

5. A dispenser according to claim 2, in which said first rib giving a sound signal and said second rib are circumferentially offset by 128° plus or minus 5°, said first rib and said second rib being respectively of a thickness of between 0.6 and 0.9 mm and of a thickness of between 0.6 and 1 mm.

6. A dispenser according to either of claims 1 or 2, in which said threads have a pitch of 8 to 16 mm/turn.

7. A dispenser according to any one of claims 1 and 2, in which said upper portion of said head comprises and outer rebate, said intermediate ring bearing on the inside an arresting rib which abuts under said rebate when the cap is in an upper position.

8. A dispenser according to claim 7, in which the said outer rebate comprises an sloping lateral surface and in which the said arresting rib comprises a rounded lateral surface, these two lateral surfaces ensuring an engagement of the cap on the head with a clamping effect of 0.05 to 0.25 mm at the radius followed by a click engagement of said rib under said outer rebate at the commencement of screwing of the cap.

9. A dispenser according to either of claims 1 or 2, in which said head comprises under said shoulder a substantially axial cylindrical portion, around which the bottom of said outer skirt engages in the position of closure of said cap, said cylindrical portion bearing a decoration that is shown by unscrewing of said cap (2), making the opening obvious.

10. A dispenser according to claim 9, in which said head, which is of plastics material, is fixed on said body, which is of plastics or metalloplastics material, by injection moulding through an annular sealing portion which is inclined at no more than 20 ° on a horizontal plane, said sealing portion binding said cylindrical portion to said body or said skirt, said body forming an outer surface of said sealing portion until less than 1 mm from said cylindrical portion, so that the overmoulded head is hidden by the outer skirt of said cap when said cap is completely screwed downwards.

11. A dispenser according to claims 1 or 2, in which said aperture of said cap is lateral, said stopper having a lateral frustoconical surface that obturates said aperture.

12. A dispenser according to claim 11, in which said cap includes an oblique depression, said aperture (14) emerging in said depression.

13. A dispenser according to either of claims 1 or 2 wherein said cap is formed of polypropylene.

* * * * *